US008894508B2

(12) United States Patent
Myrhum et al.

(10) Patent No.: US 8,894,508 B2
(45) **Date of Patent: *Nov. 25, 2014**

(54) GOLF CLUB HEAD WITH MULTI-MATERIAL FACE

(71) Applicant: Acushnet Company, Fairhaven, MA (US)

(72) Inventors: Mark C. Myrhum, Del Mar, CA (US); Uday V. Deshmukh, Carlsbad, CA (US); Charles E. Golden, Encinitas, CA (US); John Morin, Poway, CA (US); Nicholas Abbruzzese, Carlsbad, CA (US); Richard L. Cleghorn, Carlsbad, CA (US); Christopher D. Harvell, Carlsbad, CA (US); Steven J. Forshner, Vista, CA (US); Scott A. Knutson, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/854,709

(22) Filed: Apr. 1, 2013

(65) Prior Publication Data

US 2013/0225321 A1 Aug. 29, 2013

Related U.S. Application Data

(63) Continuation of application No. 13/207,344, filed on Oct. 10, 2011, now Pat. No. 8,409,032.

(51) Int. Cl.
*A63B 53/04* (2006.01)

(52) U.S. Cl.
USPC ..... 473/342; 473/345

(58) Field of Classification Search
USPC ..... 473/342, 329, 345–346, 349
See application file for complete search history.

(56) References Cited

U.S. PATENT DOCUMENTS

| | | | | |
|---|---|---|---|---|
| 3,957,194 | A | 5/1976 | Woodward | |
| 3,975,023 | A | 8/1976 | Inamori | |
| 4,220,276 | A | 9/1980 | Weisert et al. | |
| 4,575,447 | A * | 3/1986 | Hariguchi | 264/516 |
| 4,603,808 | A | 8/1986 | Stacher | |
| 5,228,615 | A | 7/1993 | Iijima et al. | |
| 5,299,807 | A | 4/1994 | Hutin | |
| 5,643,108 | A | 7/1997 | Cheng | |
| 5,669,827 | A * | 9/1997 | Nagamoto | 473/345 |
| 5,839,975 | A | 11/1998 | Lundberg | |
| 5,993,331 | A * | 11/1999 | Shieh | 473/342 |

(Continued)

FOREIGN PATENT DOCUMENTS

JP 2003-290397 * 10/2003

*Primary Examiner* — Stephen L. Blau
(74) *Attorney, Agent, or Firm* — Randy K. Chang

(57) ABSTRACT

A metal wood golf club with a striking face portion made from more than one material is disclosed. More specifically, due to the unique construction of the striking face portion having multiple materials, the present invention utilizes diffusion bonding, liquid interface diffusion, or even super plastic forming techniques to achieve the desirable bond between the more than one material used to form the striking face. The striking face portion is formed by adding a chip insert made from a secondary material that is different from the remainder of the striking face portion substantially near a geometric center of the striking face portion; wherein the secondary material has a higher Young's modulus than the remainder of the striking face portion.

8 Claims, 7 Drawing Sheets

(56) References Cited

U.S. PATENT DOCUMENTS

| | | | | |
|---|---|---|---|---|
| 6,183,381 | B1 | 2/2001 | Grant et al. | |
| 6,719,644 | B2 | 4/2004 | Beach | |
| 6,932,716 | B2 | 8/2005 | Ehlers et al. | |
| 7,029,403 | B2 * | 4/2006 | Rice et al. | 473/329 |
| 7,207,898 | B2 * | 4/2007 | Rice et al. | 473/329 |
| 7,261,643 | B2 | 8/2007 | Rice et al. | |
| 7,361,099 | B2 * | 4/2008 | Rice et al. | 473/329 |
| 7,367,899 | B2 | 5/2008 | Rice et al. | |
| 7,413,517 | B2 | 8/2008 | Butler, Jr. et al. | |
| 7,413,520 | B1 | 8/2008 | Hocknell et al. | |
| 7,775,903 | B2 | 8/2010 | Kawaguchi et al. | |
| 7,874,938 | B2 | 1/2011 | Chao | |
| 8,409,032 | B2 | 4/2013 | Myrhum et al. | |
| 2011/0319188 | A1 | 12/2011 | Narita et al. | |
| 2012/0034991 | A1 | 2/2012 | Hartwell et al. | |

* cited by examiner

GOLF CLUB HEAD WITH MULTI-MATERIAL FACE

CROSS REFERENCE TO RELATED APPLICATIONS

The present application is a Continuation of co-pending U.S. patent application Ser. No. 13/207,344, filed Oct. 10, 2011, the disclosure of which is incorporated by reference in its entirety.

FIELD OF THE INVENTION

The present invention relates generally to a golf club head having a striking face portion made from more than one material. More specifically, the present invention relates to a metalwood type golf club head wherein a secondary material is used to form a chip insert to be placed in a cavity formed near a geometric center of the striking face portion of the golf club head; wherein the secondary material has a higher modulus than the remainder of the striking face. The striking face portion, due to the unique construction, may generally be formed together using diffusion bonding, liquid interface diffusion, or super plastic forming techniques to achieve the desired bond strength. The metalwood type golf club head, by incorporating a secondary material near a geometric center of the striking face portion, improves the overall performance of the golf club head by significantly increasing the size of the sweet spot of a golf club head.

BACKGROUND OF THE INVENTION

In order to perform well in the game of golf, a golfer needs to be able to execute a variety of different golf shots; with each one of them focusing on a different aspect of the golf game. For example, in order to execute a good chip and or pitch shot, a golfer needs to be able to control the trajectory, distance, and spin of a golf ball for the golf ball to come to rest at a location that is as close to the pin as possible; or more preferably in the hole. In another example, in order to execute a good iron shot, a golfer needs to control the distance and dispersion of the golf shot to ensure that it lands on the green; sacrificing some accuracy in an attempt to achieve distance gains. Finally, in another example, in order to execute a good driver shot, a golfer needs to maximize the distance of the golf shot while maintaining a relatively straight flight path. Based on the above, it can be seen that as the clubs get longer and longer, less and less emphasis is placed on accuracy, and more and more emphasis is placed on distance.

With respect to drive type shots, golf club designers have always attempted to design wood type golf clubs that increases the overall distance of the golf shot while maintaining a relatively straight flight path. U.S. Pat. No. 6,932,716 shows one attempt of increasing the overall distance of a driver type golf club by increasing the coefficient of restitution of the driver type golf club head. More specifically U.S. Pat. No. 6,932,716 attempts to achieve this by creating a golf club head having a matrix layer composed of an interconnected reinforcement structure and a polymer material, wherein the matrix layer provides the golf club head with a greater coefficient of restitution during impact with a golf ball. U.S. Pat. No. 6,719,644 provides another example of increasing the distance of a driver type golf club head by using shallow markings that prevent stress fracture, resulting in a thinner face that provides improved coefficient of restitution.

In order to help golfers maintain a relative straight flight path in a drive type golf shot, golf club designers have attempted to create larger club heads that results in an increase in the moment of inertia of these oversized club heads; as an increase in the moment of inertia prevents the club head from undesirable twisting at impact that could send a golf shot off the intended path. U.S. Pat. No. 7,413,520 provides one example of increasing the overall size of the golf club head to help a golfer hit a ball straighter. More specifically, U.S. Pat. No. 7,413,520 discloses a golf club head having a volume ranging from 450 cubic centimeters to 475 cubic centimeters, a mass ranging from 180 grams to 225 grams, and a front to back length ranging from 4.0 inches to 5.0 inches. Moreover, U.S. Pat. No. 7,413,520 also illustrates one of the incidental effects is an increase in the moment of inertia, $I_{yy}$, about the center of gravity of the golf club head achieving numbers greater than 4000 grams-centimeters squared.

Although increasing the coefficient of restitution and the moment of inertia of a golf club head both help a golfer hit a golf ball longer and straighter, they are not the be all and end all in achieving longer and straighter drives. In fact, the size of the sweet spot is another one of those factors that can make a significant difference, but is often overlooked. U.S. Pat. No. 5,839,975 identifies the importance of the sweet spot by creating a golf club head a rib structure within the internal cavity of the golf club head to reinforce the club head to prevent collapse or other distortion while providing a relatively large sweet spot. Although U.S. Pat. No. 5,839,975 provides one of the earlier attempts of identifying and increasing the size of the sweet spot of a golf club head, it does so by adding additional material to the internal cavity of the golf club head, which can often be undesirable. In order to achieve the same goal without adding weights, a golf club designer could potentially use different materials to form the striking face.

U.S. Pat. No. 3,975,023 shows an early attempt at the usage of multiple different materials at or near the striking face portion of the golf club head, however, it does so in an attempt to increase the overall flying distance of a golf ball, and makes no mention of increasing the size of the sweet spot. U.S. Pat. No. 3,795,023 discloses a golf club that fixes the striking face of the club head with a ceramic face plate made of a sintered body of metallic oxides such as alumina ceramics, mullite ceramics, etc.

U.S. Pat. No. 7,874,938 provides a more modern attempt to use multiple different materials by using composite articles on the face plate. More specifically, U.S. Pat. No. 7,874,938 discloses a golf club head having a composite face plate, wherein the composite face plate can be made by first forming an oversized lay-up of multiple prepreg plies having a central portion and a sacrificial portion surrounding the central portion. The lay-up is at least partially cured in a mold under elevated pressure and heat, then the lay-up is then removed from the mold and the sacrificial portion is removed from the central portion to form a composite part that is substantially free of defects. However, similar to above, U.S. Pat. No. 7,874,938 makes no mention of the ability to increase the sweet spot of a golf club head.

Hence, it can be seen from above, despite all the development in recognizing the importance of increasing the size of the sweet spot, the current art is incapable of achieving improvements in sweet spot size without adding undesirable weight. On the other hand, the only attempts of using multiple materials at the striking face without increasing weight fails to incorporate a design that could increase the size of the sweet spot. Hence, there is a need in the art for a golf club head that is capable of utilizing multiple materials in a way that can increase the size of the sweet spot of a golf club head.

BRIEF SUMMARY OF THE INVENTION

In one aspect of the present invention is a golf club head comprising a striking face portion, located at a frontal portion of the golf club head, and a body portion attached to an aft portion of the striking face portion. The striking face portion further comprises a first outer layer, made out of a first material, a second backing layer, made out of a similar material as the first outer layer, and a chip insert, made out of second material. The first outer layer forms an exterior surface of the striking face portion and the second backing layer forms an interior surface of the striking face portion wherein the first outer layer and the second backing layer combine to form a cavity substantially near a geometric center of the striking face portion. The chip insert is placed within the cavity, wherein the striking face portion has a Face Thickness Ratio of less than about 0.875, the Face Thickness Ratio is defined as a thickness of the first outer layer at the geometric center divided by a thickness of the second backing layer at the geometric center.

In another aspect of the present invention is a golf club head comprising a striking face portion, located at a frontal portion of the golf club head, and a body portion attached to an aft portion of the striking face portion. The striking face portion further comprises a first outer layer, made out of a first material, a second backing layer, made out of a similar material as the first outer layer, and a chip insert, made out of second material. The first outer layer forms an exterior surface of the striking face portion and the second backing layer forms an interior surface of the striking face portion wherein the first outer layer and the second backing layer combine to form a cavity substantially near a geometric center of the striking face portion. The chip insert is placed within the cavity, wherein the first material is different from the second material, and the second material has a Young's modulus that is greater than a Young's modulus of the first material.

In another aspect of the present invention is a golf club head comprising a striking face portion, located at a frontal portion of the golf club head, and a body portion attached to an aft portion of the striking face portion. The striking face portion further comprises a first outer layer, made out of a first material, a second backing layer, made out of a similar material as the first outer layer, and a chip insert, made out of second material. The first outer layer forms an exterior surface of the striking face portion and the second backing layer forms an interior surface of the striking face portion wherein the first outer layer and the second backing layer combine to form a cavity substantially near a geometric center of the striking face portion. The chip insert is placed within the cavity, wherein the striking face portion is formed using a liquid interface diffusion process.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
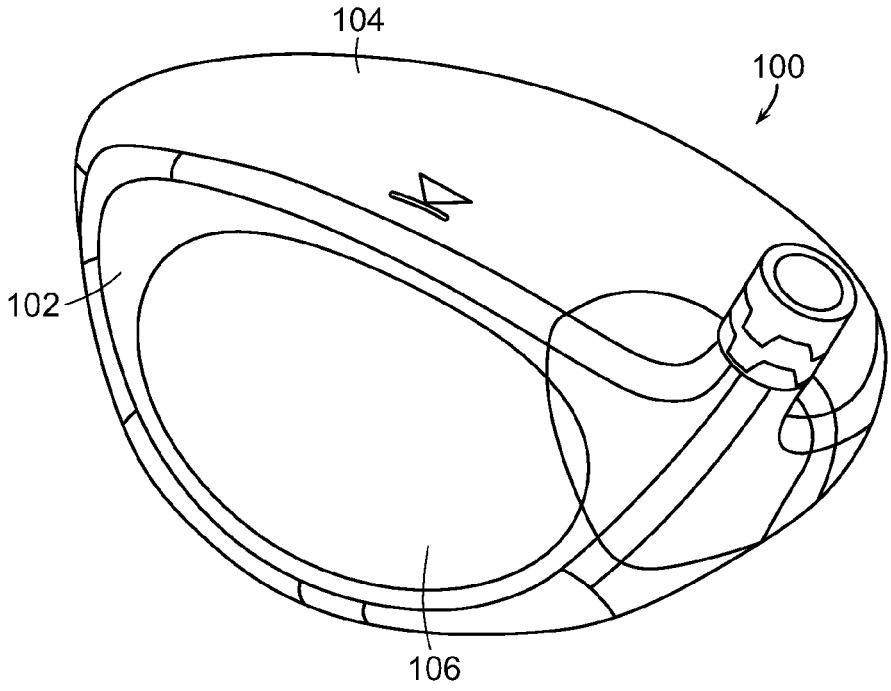
FIG. 1 of the accompanying drawings shows a perspective view of a golf club head in accordance with an exemplary embodiment of the present invention.

FIG. 1 of the accompanying drawings shows a perspective view of a golf club head 100 in accordance with an exemplary embodiment of the present invention. More specifically, FIG.

1 of the accompanying drawings shows a golf club head 100 having a striking face portion 102 and a body portion 104. It should be noted that in this current exemplary embodiment, the striking face portion 102 may further comprise of a face insert 106 to allow the manufacturers to manipulate the geometry of the rear surface of the striking face portion 102. However, in order to truly understand the inventive features of the present invention, one must look into the cross-sectional view of the striking face portion 102 and/or the face insert 106 that can show the multiple materials used to construct the face insert 106. Before diving into a discussion regarding the multi-material construction of the face insert 106 it is worthwhile to establish here that although the subsequent figures will all utilize a face insert 106, the present invention does not require the usage of a face insert 106; in fact, the present invention is intended to include any type of multi-material construction near the striking face portion 102 such as a face cup, an L-cup, or any other construction without departing from the scope and content of the present invention.

Figure 2:
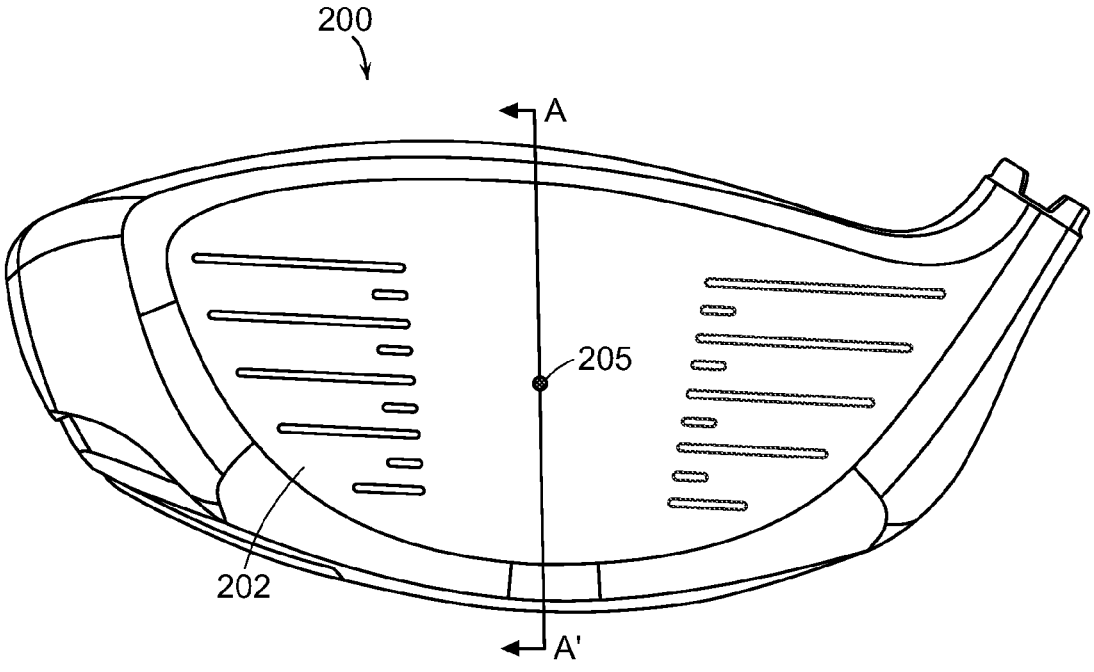
FIG. 2 of the accompanying drawings shows a frontal view of a golf club head in accordance with an exemplary embodiment of the present invention, allowing cross-sectional lines A-A' to be shown.

In order to show a cross-sectional view of the striking face 102, FIG. 2 of the accompanying drawings shows a frontal view of a golf club head 200, allowing cross-sectional lines A-A' to be drawn. In addition to showing the cross-sectional lines A-A', FIG. 2 of the accompanying drawings also shows a geometric center 205 of the striking face portion 202. The geometric center 205 of the striking face portion 202 is important to the current invention because the placement of the secondary material may generally be substantially behind the geometric center 205 of the striking face portion 202.

Figure 3:
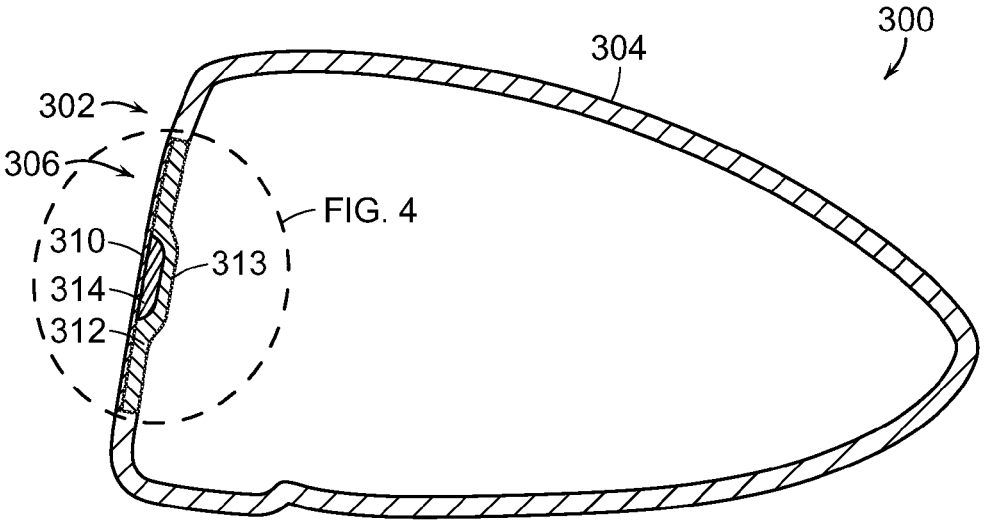
FIG. 3 of the accompanying drawings shows a cross-sectional view of a golf club head in accordance with an exemplary embodiment of the present invention taken along cross-sectional line A-A'.

FIG. 3 of the accompanying drawings shows a cross-sectional view of a golf club head 300 taken along cross-sectional line A-A' shown in FIG. 2. The cross-sectional view of golf club head 300 shows the multi-material composition of the striking face portion 302 of the golf club head. More specifically, the striking face portion 302 further comprises of a first outer layer 310, a second backing layer 312, and a chip insert 314 juxtaposed or encapsulated between the first outer layer 310 and the second backing layer 312. The first outer layer 310, as disclosed in this exemplary embodiment of the present invention may generally be formed out of a first material. The first material may generally be a titanium type material having a Young's modulus of between about 80 GPa to about 130 GPa, more preferably between about 90 Gpa to about 120 GPa, and most preferably between about 95 GPa to about 115 GPa. However, the first material need not be made out of a titanium material, and could be made out of any material that is sufficiently durable to endure the impact forces with a golf ball without departing from the scope and content of the present invention.

First outer layer 310, although shown in FIG. 3 to be a thin sheet of titanium, can also be created using a sprayed coating type of titanium without departing from the scope and content of the present invention. Because it is generally desirable to keep the thickness of first outer layer 310 as thin as possible to minimize its size and weight, the present construction can be achieved by spray coating the front surface of the striking face portion 302 to significantly reduce the thickness of the first outer layer 310, and to meet the USGA requirement that indicates the frontal face portion has to be all made of the same material.

The second backing layer 312, as shown in this current exemplary embodiment of the present invention, may generally be formed out of a similar first material used to form the first outer layer 310. Similar material, as referred to in this particular reference may be other types of titanium such as Ti-811, SP-700, 15-3-32, or any $\alpha$ alloy, any $\beta$ alloy, or even $\alpha$-$\beta$ alloys. It should be noted here that once again, the first material, although generally titanium as discussed above, could be made out of any other material as well. Moreover, although the first outer layer 310 and the second backing layer 312 may generally be made out of a similar titanium material for its high strength and low density characteristics, they could also be made out of completely different materials to achieve different goals and objectives without departing from the scope and content of the present invention. It should be noted here that the first outer layer 310 and the second backing layer 312 combine with one another to form a cavity 313 substantially near a geometric center; adapted to receive a chip insert 314.

The cavity 313, as shown in the current exemplary embodiment of the present invention, may generally have a geometric shape that is identical to the geometric shape of the chip insert 314 to ensure proper bonding of all the components. However, cavity 313 need not have the exact same geometry as the chip insert 314, in fact it can take on other geometric shapes without departing from the scope and content of the present invention so long as it has enough interface with the chip insert 314 to ensure a secure bond between the first outer layer 310, the second backing layer 312, and itself.

Chip insert 314, as shown in the current exemplary embodiment of the present invention, may generally formed out a second material, which is different from the first material. More specifically, the second material may generally have a Young's modulus greater than the Young's modulus of the first material to allow the central portion of the golf club head to move in and out of the golf club head 300 as a single unitary entity to improve performance. Even more specifically, the second material may generally have a Young's modulus of greater than about 130 GPa, more preferably greater than about 150 GPa, and most preferably greater than about 170 GPa. In addition to having a high modulus of elasticity, the second material may generally have a yield strength of greater than about 500 MPa, more preferably greater than about 600 MPa, and most preferably greater than about 700 MPa. Finally, the second material may generally have an ultimate tensile strength of greater than about 750 MPa, more preferably greater than about 850 MPa, and most preferably greater than about 950 MPa. With the material properties of the chip insert 314 disclosed above, it can be seen that there are numerous materials that fit those characteristics, especially in view of the fact that the first material could deviate from titanium in some embodiments. However, in one preferred embodiment of the present invention, the chip insert 314 may be constructed out of steel for its ease of availability just as much as for its innate ability to meet the criteria above. Numerous other materials such as carbon steel, stainless steel, ceramic, tungsten, plastic, carbide, boron carbide, metal injection molding materials, or any other material that fits the description above may all be used without departing from the scope and content of the present invention so long as it meets the material properties above.

Figure 4:
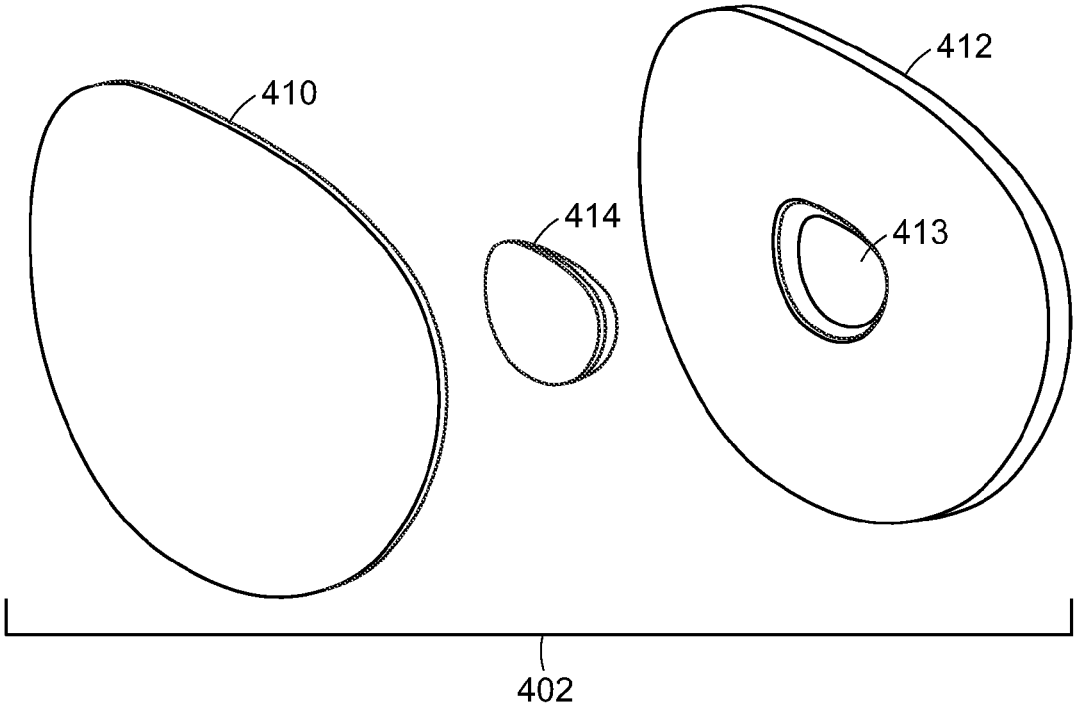
FIG. 4 of the accompanying drawings shows an exploded view of a face insert containing a chip insert in accordance with an exemplary embodiment of the present invention.

FIG. 4 of the accompanying drawing showing an exploded view of the first outer layer 410, second backing layer 412 having a cavity 413, and the chip insert 414, provides a clearer illustration of the relationship between the various components used to construct this multi-material striking face portion 402. Despite the relative small number of components involved in the construction of this multi-material striking face portion 402, the ability to seamlessly bond the components together requires more explanation. Although numerous bonding methods such as welding and brazing could potentially be used to join the components of the striking face portion 402 together, those methodologies generally do not provide a sufficiently strong enough bond amongst the various components to withstand the high impact forces generally associated with the striking face portion 402 of a golf club head.

In order to address the flaws of the traditional bonding methods, the present invention incorporates numerous advanced bonding technologies such as diffusion bonding, liquid interface diffusion, diffusion brazing, or even super plastic forming to name a few, as these methodologies, amongst others, could be used achieve the bond strength needed for golf club head applications.

In one exemplary embodiment the first outer layer 410, the second backing layer 412, and the chip insert 414 may be formed together using diffusion bonding techniques. Diffusion bonding is a solid state welding process by which two metals can be bonded together by causing a migration of atoms across the interface by increasing concentration gradients. Diffusion bonding techniques generally involve heating up the materials to an elevated temperature for an extended period of time to allow the materials to create an extremely strong bond across a large surface. More details about the diffusion bonding process can be found in U.S. Pat. No. 7,367,899, the disclosure of which is incorporated by reference in its entirety.

In an alternative embodiment of the present invention, the components of the striking face portion 402 may be joined together using liquid interface diffusion techniques. Liquid interface diffusion bonds eliminates some of the drawbacks of plain diffusion bonding by utilizing a titanium alloy interface material, an eutectic material, or a ternary material to lesson the surface preparation needed. More specifically, because of the existence of the titanium alloy interface material, liquid interface diffusion drastically reduces the smoothness, cleanliness, and flatness requirement of the mating surfaces to ensure proper diffusion bonding. More details about liquid interface diffusion can be found in U.S. Pat. No. 3,957,194, the disclosure of which is incorporated by reference in its entirety.

In a further alternative embodiment of the present invention, the components of the striking face portion 402 may be joined together using super plastic forming. Super plastic forming is a metalworking process for forming metallic sheets based on the theory of super elasticity. The super plastic forming process may generally involve metals having ultra fine grain size being heated up to promote super elasticity, allowing large and complex geometries to be created in one operation. More details about super plastic forming can be found in U.S. Pat. No. 4,603,808, the disclosure of which is incorporated by reference in its entirety.

Figure 5:
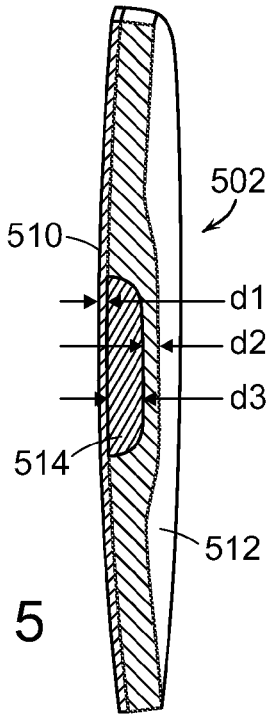
FIG. 5 of the accompanying drawings shows an enlarged cross-sectional view of a golf club head in accordance with an exemplary embodiment of the present invention taken at circle C shown in FIG. 3.

FIG. 5 of the accompanying drawings shows an enlarged view of circle C shown in FIG. 3, allowing more details regarding the striking face portion 502 to be shown. As it can be seen, the striking face portion 502 has all of the same components such as a first outer layer 510 having a first thickness d1, a second backing layer 512 having a second thickness d2, and a chip insert 414 having a third thickness d3. It is worthwhile to mention here that the measurement of the relative thicknesses d1, d2, and d3 may all generally be taken at the geometric center of the striking face portion 502, despite the fact that the FIG. 5 has illustrates the relative thicknesses at locations that are slightly offset from the center for ease of illustration. First thickness d1, as shown in the figures of this current exemplary embodiment may be kept relatively thin to save unnecessary weight as the front of the face is in compression during impact. The internal stress caused by the compression forces experienced by the first outer layer 510 may generally be smaller than the internal stress caused by the tension forces experienced by the back of the striking face portion 502, hence lessening the thickness requirement of thickness d1. More specifically, first thickness d1 may generally be less than about 0.7 mm, more preferably less than about 0.6 mm, and most preferably less than about 0.5 mm. Second backing layer 512 having a second thickness d2, as previously mentioned, is the part of the striking face portion 502 that is subjected to the highest internal stress as it comes in tension due to impact with a golf ball; hence requiring the second thickness d2 to be significantly thicker than the first thickness d1. More specifically, second thickness d2 may generally be greater than about 0.8 mm, more preferably thicker than 0.9 mm, and most preferably thicker than 1.0 mm. Finally, third thickness d3 shows the thickness of the chip insert 514, wherein thickness d3 may generally be between about 1.8 mm to about 2.2 mm, more preferably between about 1.9 mm to about 2.1 mm, most preferably about 2.0 mm.

Although the relative thicknesses of the various regions of the striking face portion 502 have all been disclosed above, it is worthwhile to re-emphasize the importance of the thicknesses with respect to one another. More specifically, because the second backing layer 512 is subjected to tension stresses that are significantly higher than the compressive stresses at the first outer layer 510, the thickness d2 of the second backing layer 512 needs to be significantly greater than the thickness of the first outer layer 510. In order to properly capture the thickness requirements of the various portions of the various components required for the striking face portion 502 to have sufficient durability, a "Face Thickness Ratio" is created below in Equation (1) to capture the relationship between thickness d1 and thickness d2.

$$\text{Face Thickness Ratio} = \frac{\text{Thickness } d1}{\text{Thickness } d2} \qquad \text{Eq. (1)}$$

The striking face portion 502 in accordance with an exemplary embodiment of the present invention may generally have a "Face Thickness Ratio" of less than about 0.875, more preferably less than about 0.66, and most preferably less than about 0.50.

Chip insert 514 may generally be substantially circular or oval in shape with a major axis length of about 21.75 mm and a minor axis of about 11.63 mm. Combined with an approximate thickness of about 2.0 mm described above, the chip insert 514 may generally have a volume of about 371.45 $mm^3$; however minor deviations in the total volume of the chip insert 514 could occur while still achieving the same performance gains. More specifically, chip insert 514 may have a volume of between about 300 $mm^3$ and about 400 $mm^3$, or even a volume of between about 250 $mm^3$ and 450 $mm^3$, all without departing from the scope and content of the present invention. Finally, because it may generally be undesirable to add excessive weight to the striking face portion 502 of the golf club head, it is generally desirable to keep the weight of the chip insert 514 as minimal as possible. Hence, given some of the material properties discussed above and the volume ranges above, the chip insert 514 may generally have a mass of less than 3.0 grams, more preferably less than 2.95 grams, and most preferably less than 2.90 grams.

Before moving onto discussions about other embodiments of the present invention, it is important to point out here that the chip insert 514 may take on a dome like shape, with the flat side facing the first outer layer 510 and the rounded side facing the second backing layer 512. This specific construction eliminates sharp corners at the rear of the second backing layer 512, which could be points of elevated stress when subjected to impact forces. Because the tension stresses at the second backing layer 512 is significantly higher than the compressive stresses at the first outer layer 510, it is important to keep the rounded side of the cavity on the second backing layer 512. The flat side of the dome interacts with the first outer layer 510 because the compressive stresses are not as significant, and because this type of dome cavity construction is easier to create using traditional machining methods.

Figure 6:
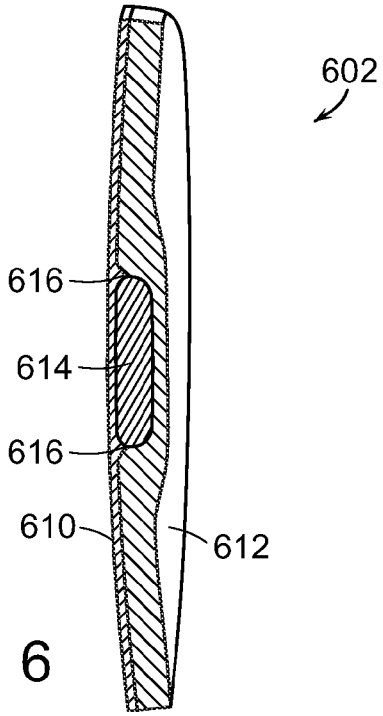
FIG. 6 of the accompanying drawings shows an enlarged cross-sectional view of a golf club head in accordance with an alternative embodiment of the present invention taken at circle C shown in FIG. 3.

FIG. 6 of the accompanying drawing shows an enlarged cross-sectional view of a striking face portion 602 in accordance with an alternative embodiment of the present invention wherein the chip insert 614 takes on a disk like shape instead of a dome like shape. Making the chip insert 614 out of a disk like shape instead of a dome like shape may further improve the performance of the golf club head by increasing the size of the sweet spot; however such geometry could make it more difficult to manufacture. More specifically, FIG. 6 shows the first outer layer 610 having a plurality of protrusions 616 at the rear of the first outer layer 610 to eliminate any gaps between the components.

Figure 7:
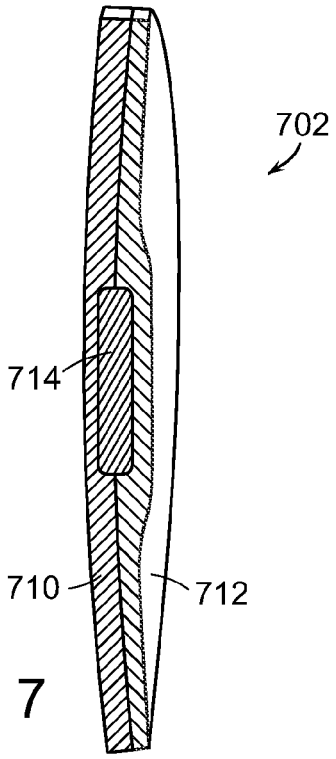
FIG. 7 of the accompanying drawings shows an enlarged cross-sectional view of a golf club head in accordance with a further alternative embodiment of the present invention taken at circle C shown in FIG. 3.

FIG. 7 of the accompanying drawings shows an enlarged cross-sectional view of a striking face portion 702 in accordance with an alternative embodiment of the present invention wherein the chip insert 714 takes on a disk like shape instead of a dome like shape. However, different from the striking face portion 602 shown in FIG. 6, striking face portion 702 in this embodiment has a different parting line allowing the cavity to be formed partially on the first outer layer 710 and partially on the second backing layer 712. This type of construction allows the utilization of a disk shaped chip insert 714 without abnormal shapes on either of the components.

Figure 8:
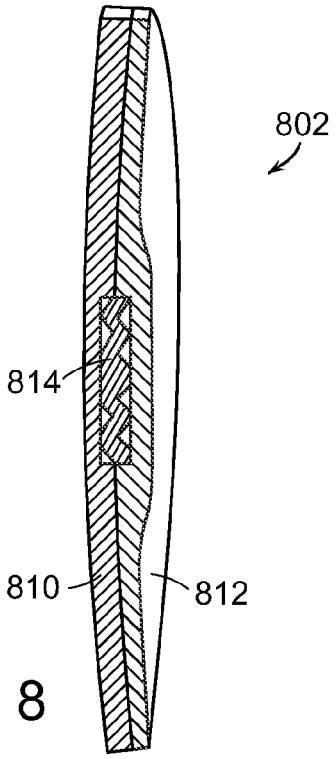
FIG. 8 of the accompanying drawings shows an enlarged cross-sectional view of a golf club head in accordance with an alternative embodiment of the present invention taken at circle C shown in FIG. 3.

FIG. 8 of the accompanying drawings shows a an enlarged cross-sectional view of a striking face portion 802 in accordance with an alternative embodiment of the present invention wherein the chip insert 814 has a corrugated geometry. Having a chip insert 814 with a corrugated construction allows the chip insert 814 to achieve the high modulus required all while reducing the overall weight of the chip insert 814.

Figure 9:
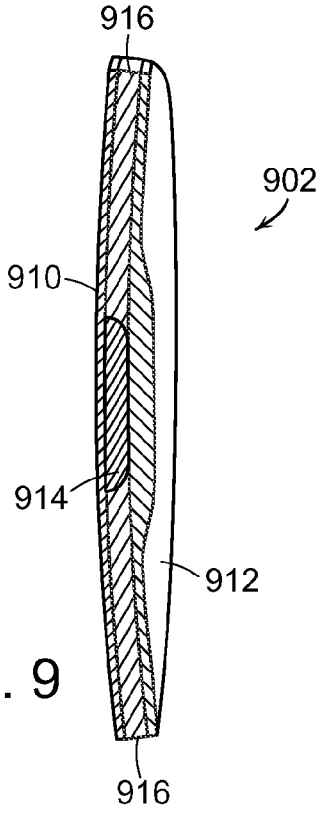
FIG. 9 of the accompanying drawings shows an enlarged cross-sectional view of a golf club head in accordance with an alternative embodiment of the present invention taken at circle C shown in FIG. 3.

FIG. 9 of the accompanying drawings shows an enlarged cross-sectional view of a striking face portion 902 in accordance with an alternative embodiment of the present invention wherein an extra intermediate layer 916 is sandwiched in between first outer layer 910 and the second backing layer 912. The incorporation of an extra intermediate layer 916 significantly simplifies manufacturing, as both first outer layer 910 and the second backing layer 912 can now be made out of completely flat surfaces. The only machining that needs to be done to create a cavity for the chip insert 914 is in the intermediate layer 916, which can be easily accomplished without any limitations on the depth of the cavity. In the current exemplary embodiment of the present invention, intermediate layer 916 may generally be constructed out of a similar material as the first outer layer 910 and the second backing layer 912, however, intermediate layer 916 could be constructed out of completely different materials without departing from the scope and content of the present invention so long as it is capable of being formed together with the other components.

Figure 10:
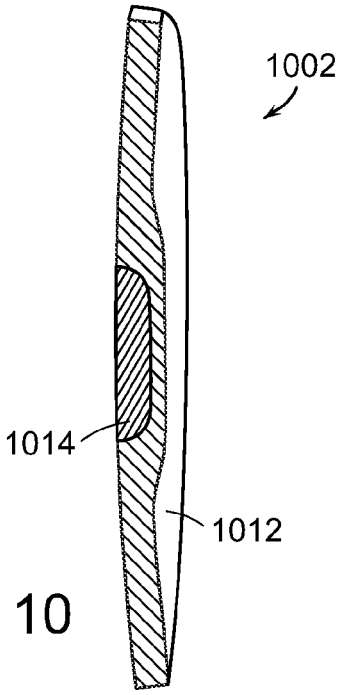
FIG. 10 of the accompanying drawings shows an enlarged cross-sectional view of a golf club head in accordance with an alternative embodiment of the present invention taken at circle C shown in FIG. 3.

FIG. 10 of the accompanying drawings shows an enlarged cross-sectional view of a striking face portion 1002 in accordance with an alternative embodiment of the present invention wherein it only has a second backing layer 1012 having a cavity that is filled in with a chip insert 1014. Notice in this embodiment the striking face portion 1002 does not have a first outer layer to cover up the chip insert 1014 to ensure that the outer striking surface is of uniform material. Although this embodiment may not conform to the current USGA rules of golf requiring the striking face to be made out of a uniform material, it could potentially provide significant performance gains from all other previously mentioned embodiments that add unnecessary weight to the frontal surface of the striking face portion 1002. As mentioned before, because the stresses at the frontal portion is so minimal, it is not necessary to reinforce the frontal portion, thus allowing the chip insert 1014 to be exposed. In a slightly different embodiment than what is shown in FIG. 10, the frontal portion of the striking face portion 1002 could be covered with a thin film of titanium or any other material to achieve the weight savings of the embodiment shown in FIG. 10 all while visually conforming to the USGA requirements.

Figure 11:
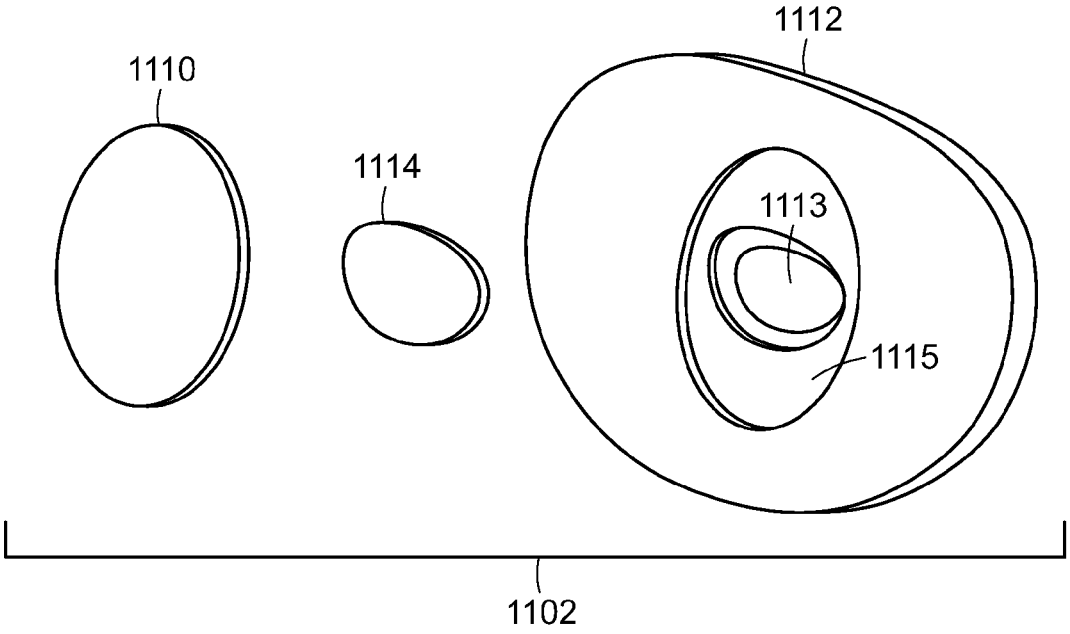
FIG. 11 of the accompanying drawings shows an exploded view of a face insert containing a chip insert in accordance with an alternative embodiment of the present invention.

FIG. 11 of the accompanying drawings shows an exploded view of a striking face portion 1102 in accordance with an alternative embodiment of the present invention. More specifically, in this alternative embodiment of the present invention the first outer layer 1110 may not need to occupy the entire frontal surface to achieve the same objectives. Although this embodiment shown in FIG. 11 may require more machining work in terms of machining out an outer pocket 1115 in addition to the cavity 1113, it significantly reduces the bonding surface between the components. The reduction of the bonding surface may be desirable in situations that involve diffusion bonding or liquid interface diffusion processes are used, as both of these processes require significant surface preparation to achieve a bond. The first outer layer 1110 in this current exemplary embodiment may take on the shape of a circular disk in order to provide a shape that is easier to machine, however, as it will be shown in more detail later, first outer layer 1110 may take on any shape that is smaller than the outer perimeter of the striking face portion 1102 without departing from the scope and content of the present invention. Finally, it is worth to note here that the first outer layer 1110 may generally be made out of the same titanium material as the second backing layer 1112 allowing the end product to have a uniform striking surface in conformity with the USGA rules. However, the first outer layer 1110 may be formed out of a substantially similar, or even completely different material than the second backing layer 1112 without departing from the scope and content of the present invention.

Figure 12:
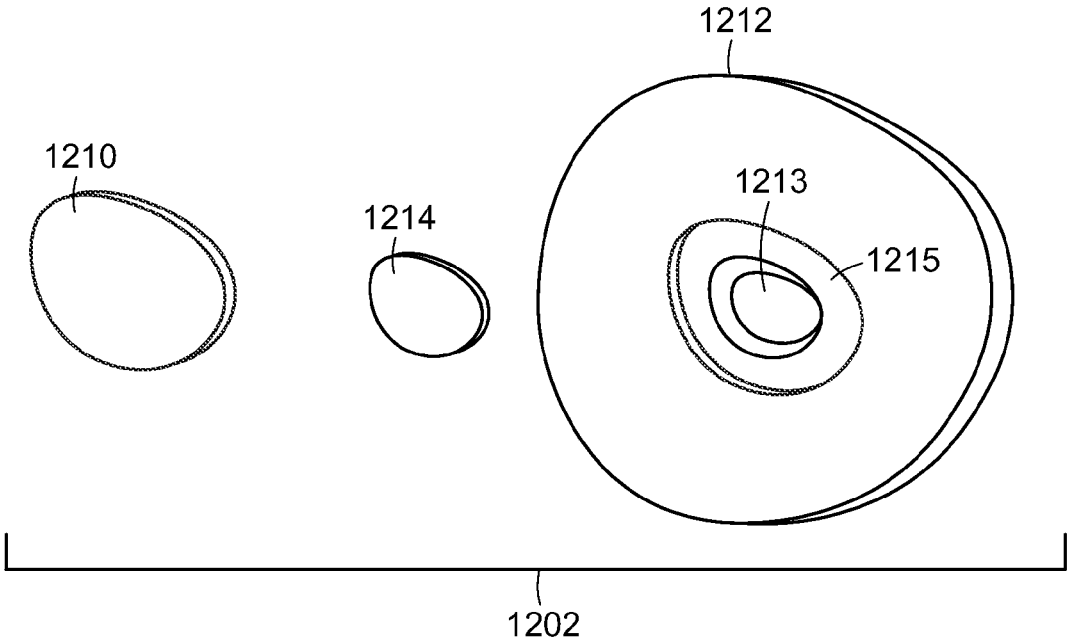
FIG. 12 of the accompanying drawings shows an exploded view of a face insert containing a chip insert in accordance with an alternative embodiment of the present invention.

FIG. 12 of the accompanying drawings shows an exploded view of a striking face portion 1202 in accordance with an alternative embodiment of the present invention. More specifically, the first outer layer 1210 may have a shape that significantly resembles the shape of the chip insert 1214, but large enough to cover the chip insert 1214 itself. Correspondingly, the outer pocket 1215 may also take on the similar shape of the first outer layer 1210 without departing from the scope and content of the present invention. Having the first outer layer 1210 take on a shape that is similar to the shape of the chip insert 1214 may provide a more focused shape for the first outer layer 1210, further reducing the amount of surface preparation needed for the diffusion bonding of the various components.

Figure 13:
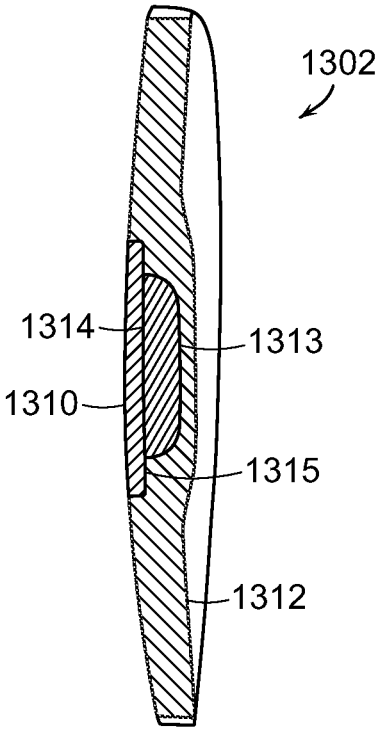
FIG. 13 of the accompanying drawings shows an enlarged cross-sectional view of a golf club head in accordance with an alternative embodiment of the present invention taken at circle C shown in FIG. 3.

Finally, FIG. 13 of the accompanying drawings shows an enlarged cross-sectional view of the embodiments of the present invention wherein the first outer layer 1310 may not cover up the entire frontal striking surface of the golf club head. More specifically, as the cross-sectional image of FIG. 13 shows, the first outer layer 1310 may only partially cover the frontal striking surface. The cross-sectional view of this embodiment also shows that the bonding surfaces between the components to be significantly reduced, to minimize the surface preparation needed for diffusion bonding techniques.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting form the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a striking face portion located at a frontal portion of said golf club head; and a body portion attached to an aft portion of said striking face portion;

wherein said striking face portion further comprises;

a first outer layer, made out of a first material, forming an exterior surface of said striking face portion;

a second backing layer forming an interior surface of said striking face portion;

wherein said first outer layer and said second backing layer combine to form a cavity substantially near a geometric center of said striking face portion; and a chip insert, made out of a second material, placed within said cavity;

wherein said second material has a Young's modulus that is greater than a Young's modulus of said first material; and wherein said striking face portion has a Face Thickness Ratio of less than about 0.50, said Face Thickness Ratio is defined as a thickness of said first outer layer at said geometric center divided by a thickness of said second backing layer at said geometric center, and wherein said striking face portion is formed using a liquid interface diffusion process.

2. The golf club head of claim 1, wherein said second Young's modulus is greater than about 130 GPa.

3. The golf club head of claim 2, wherein said second Young's modulus is greater than about 150 GPa.

4. The golf club head of claim 3, wherein said second Young's modulus is greater than about 170 GPa.

5. The golf club head of claim 1, wherein said chip insert has a volume of about 371.45 $mm^3$.

6. A golf club head comprising:

a striking face portion located at a frontal portion of said golf club head; and a body portion attached to an aft portion of said striking face portion;

wherein said striking face portion further comprises;

a first outer layer, made out of a first material, forming at least a portion of an exterior surface of said striking face portion;

a second backing layer forming an interior surface of said striking face portion;

wherein said first outer layer and said second backing layer combine to form a cavity;

a chip insert, made out of a second material of steel, placed within said cavity; and wherein said chip insert has a volume of between about 250 $mm^3$ and 450 $mm^3$, wherein said first material is different from said second material, wherein said second material has a Young's modulus that is greater than a Young's modulus of said first material, wherein said second Young's modulus is greater than about 130 GPa, wherein said chip insert has a volume of about 371.45 $mm^3$, and wherein said striking face portion has a Face Thickness Ratio of less than about 0.875, said face thickness ratio is defined as a thickness of said first outer layer at said geometric center divided by a thickness of said second backing layer at said geometric center.

7. The golf club head of claim 6, wherein said striking face portion has a Face Thickness Ratio of less than about 0.66.

8. The golf club head of claim 7, wherein said striking face portion has a Face Thickness Ratio of less than about 0.50.

* * * * *